US005434591A

United States Patent [19]

Goto et al.

[11] Patent Number: 5,434,591

[45] Date of Patent: Jul. 18, 1995

[54] SCROLLING METHOD AND APPARATUS IN WHICH DATA BEING DISPLAYED IS ALTERED DURING SCROLLING

[75] Inventors: Masahiro Goto, Hitachi; Seiichi Shinno, Katsuta, both of Japan

[73] Assignee: Hitachi, Ltd., Tokyo, Japan

[21] Appl. No.: 570,299

[22] Filed: Aug. 20, 1990

[30] Foreign Application Priority Data

Dec. 15, 1989 [JP] Japan ..... 1-323743

[51] Int. Cl.[6] ..... G09G 1/06

[52] U.S. Cl. ..... 345/123; 345/125; 340/995

[58] Field of Search ..... 364/449; 340/995; 345/123, 125

[56] References Cited

U.S. PATENT DOCUMENTS 4,996,645 2/1991 Schneyderberg Van Der Zon ..... 340/995

FOREIGN PATENT DOCUMENTS 0208619 12/1983 Japan ..... 364/449
0073111 4/1988 Japan ..... 340/995
0101706 5/1988 Japan ..... 340/995
0265113 11/1988 Japan ..... 340/995
0161111 6/1989 Japan ..... 340/995

*Primary Examiner*—Ulysses Weldon
*Attorney, Agent, or Firm*—Antonelli, Terry, Stout & Kraus

[57] ABSTRACT

In a scrolling of a display of graphic data in response to an operator command, a characteristic of the data is altered, according to the speed of the scrolling, to facilitate the viewing of the data as the data is scrolled. In one case, a selected part of the data is omitted from the display during scrolling so that a reduced amount of data is displayed, the amount of reduction in displayed data being proportional to the scrolling period. As another possibility, or in addition thereto, the magnification of the data being displayed is varied with variation in the scrolling speed. The magnification can be controlled so that the apparent speed of the movement of the displayed data at a given scrolling speed is maintained substantially constant as the scrolling period is varied from the given scrolling speed. A further possibility is to alter the data by emphasizing a portion of the data in the display in a selected manner. Thus, even when the scrolling speed is set at the maximum speed which the human eye can follow, the displayed data can be viewed easily, and the retrieval operation there by can be facilitated.

18 Claims, 12 Drawing Sheets

112–115 : DURING SCROLLING

112~115 : DURING SCROLLING

132~135 : DURING SCROLLING

112~115: DURING SCROLLING
(MAGNIFICATION IS CHANGED FROM 111 AND 116)

SCROLLING METHOD AND APPARATUS IN WHICH DATA BEING DISPLAYED IS ALTERED DURING SCROLLING

BACKGROUND OF THE INVENTION

The present invention relates to a scrolling method and apparatus in which a partial area of information stored in a frame memory is displayed on the display screen of a display device, and in which an operator moves the area presented as a display on the display screen through scrolling.

The scrolling of display data, particularly a system capable of smooth scrolling, has heretofore been discussed in a book entitled "Computer Graphics" written by J. D. FOLEY/A. VAN DAM, pp. 505–507. Here, a technique called the "refresh buffer conversion" is employed. With this technique, parts of a pattern stored in a refresh buffer (also called a "frame memory") are repeatedly converted into view frames and displayed on the screen of a display device, while the displayed parts (called "windows" of the refresh buffer or frame memory) are accessed in succession, whereby the pattern is scrolled.

An example of a screen display in the case where map information is successively scrolled using the prior-art system is shown in FIG. 12, in which display 121 shows a displayed state before the scrolling, and displayed states are presented as indicated by 122→123→124→125 during scrolling. The displayed state 126 is established after the scrolling completed.

In the prior-art system, all of the data in the frames of data stored in the frame memory are scrolled. Therefore, when the pattern has a large amount of data which is scrolled at high speed, the successively displayed states become confused and are difficult to see. Another problem is that, since the afterimage of the last frame of a pattern of data remaining on the face of a cathode-ray tube lies over a new frame of the pattern of data, the display tends to flicker and data in the pattern to be found through the scrolling operation is difficult to recognize.

Particularly, in case of displaying and scrolling a portion of an extensive drawing, the scrolling speed of the system must be increased in order to enhance the pattern retrieval capability of the search operation. In such cases, the above-mentioned problems are enhanced.

There has been another prior-art system, which is designed to facilitate the retrieval of a desired picture in such a way that the whole view of a pattern of data is presented on a part of the screen of a display, and an area of the pattern being indicated is denoted by a square or other mark in the overall view. This system, however, has the problem that, when the amount of data forming the pattern is large, the overall view becomes too small to easily recognize the details of the pattern.

SUMMARY OF THE INVENTION

An object of the present invention is to provide a display picture scrolling method and apparatus which is designed to reduce or eliminate the flickering of a displayed pattern during a scrolling operation, thereby to enhance the operating efficiency of an the operation.

Another object of the present invention is to provide a display scrolling method and apparatus which facilitate the tracking of a picture to-be-retrieved.

Still another object of the present invention is to provide a display scrolling method and apparatus which can raise the retrieval speed sufficiently to allow the human eye to follow the movement of a displayed picture on the screen.

In order to accomplish the above objects, a display scrolling system according to the present invention makes it possible to alter a characteristic of the displayed data, such as the amount of information which is displayed during a scrolling operation.

To this end, as one aspect of the present invention, a display device is furnished with a plurality of frame memories, at least one of which is provided with a readout masking circuit for inhibiting the readout of certain data from the frame memory, whereby pattern information items which need not be displayed during the scrolling operation and pattern information items which need to be displayed are stored in separate frame memories. As regards the display being scrolled, the amount of pattern information to be displayed is reduced by masking the readout of certain data from the frame memory or memories during scrolling.

When specified pattern information is masked as described above, the amount of pattern information to be displayed decreases, and flickering of the displayed pattern during a scrolling operation is reduced, so that a picture to be retrieved is easily found and the operating efficiency of the system is increased.

In another aspect of the present invention, a display controller is provided with a coordinate transformer which enlarges or reduces the size of an object to-be-displayed on a screen, whereby the factor of enlargement or the factor of reduction is changed during a scrolling operation. Thus, when the moving speed of the object to-be-displayed on the screen is changed, the magnification of the displayed data can be enlarged or reduced so that the apparent moving speed will lie within a predetermined range which the human eye can follow. In this way, a desired picture is retrieved at high speed and with ease.

PREFERRED EMBODIMENTS OF THE INVENTION

Now, embodiments of the present invention will be described with reference to the drawings.

Figure 3:
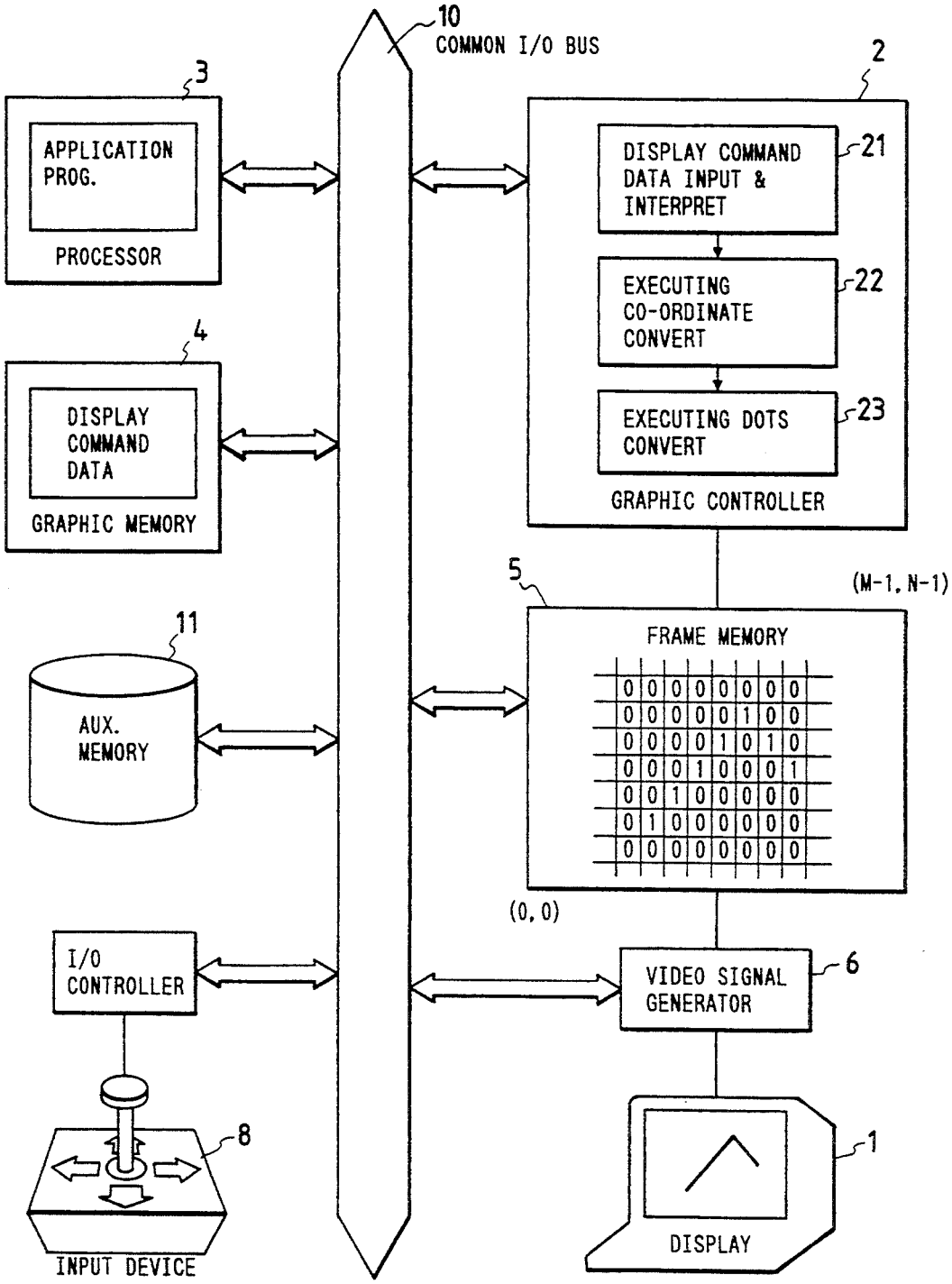
FIG. 3 is a schematic block diagram showing the construction of a displayed picture scrolling system to which the present invention is applied.

FIG. 3 shows an example of construction of a picture scrolling system in which the present invention is to be realized. Referring to the figure, a processor 3 is connected to a common I/O (input/output) bus 10, and it contains an application program for executing a graphic processing. As the graphic processing proceeds, display command data is stored in a pattern command data (graphic) memory 4. This memory 4 has a large capacity and can store at one time an extensive amount of data, such as map information or the like. However, in a case where a larger amount of information needs to be displayed, data is stored also in an auxiliary memory 11, such as a disc storage unit.

The display command data stored in memory 4 are data items for defining the shapes etc, of patterns to-be-displayed, and the contents of the data items specify the sorts of patterns to-be-displayed, such as straight lines, circles, curves, characters and symbols, and the positions, sizes etc. of the patterns to-be-displayed. In displaying a map by way of example, the individual lines, characters etc. on the map are stored in the form of such display command data.

The display command data is loaded under control of the processor 3 from the memory 4 to a graphic controller 2, which interprets the content thereof and stores pattern information items in a frame memory 5 in terms of vector (bit map) information. The frame memory 5 has a capacity (for example, 1000 pixels×1000 pixels) which is larger than the screen size of a display device 1. In a color display operation, one pixel consists of about 4–24 bits, so that the memory capacity of frame memory 5 may be as large as about 1–3 Mbytes.

The bit map information developed in the frame memory 5 is loaded in a video signal generator 6. Here, the received bit map information is subjected to D/A (digital-to-analog) conversion into a video signal, which presents a pattern on the screen of the display device 1. What part of the vector information drawn in the frame memory 5 is to be loaded in the video signal generator 6 and to be displayed is determined by a frame memory window, the position of which can be designated by the processor 3. Using an input unit 8, such as a mouse, a tablet or the like, the scroll direction, scroll speed, etc., which the operator of the system has specified, are inputted to the processor 3 through an I/O controller 7.

The graphic controller 2 includes a part 21 which loads and interprets the pattern command data, a part 22 which computes the data required for display of the pattern, and a part 23 which develops the dot pattern to be stored in the frame memory 5.

Figure 4:
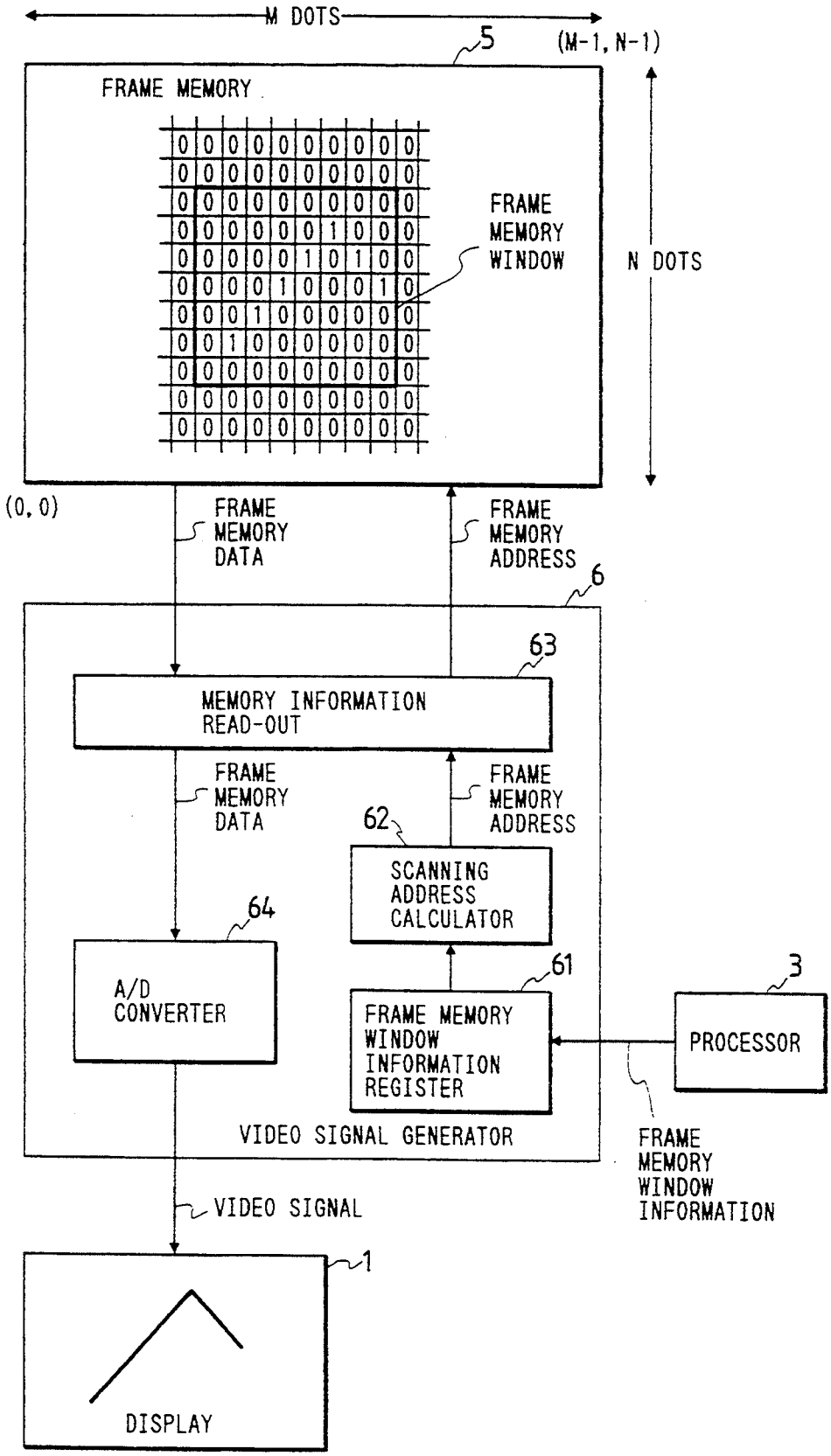
FIG. 4 is a block diagram showing part of FIG. 3 in detail.

Referring now to FIG. 4, the operations of the frame memory 5 and the video signal generator 6, which are characteristic of the present invention, will be described in more detail. In this example, a black-and-white display operation will be mentioned to simplify the description. The information items representing the dots are expressed by the binary values of white=0 and black= 1 in the frame memory 5. The graphic controller 2 writes the dots for the display image into the corresponding addresses of the frame memory 5 as values of "1" or "0".

On the other hand, the video signal generator 6 reads out the data items from the respective addresses of the frame memory 5 by means of a memory information reader 63, while scanning the rows of the frame memory 5, in general, rightwards and downwards from the left upper corner thereof. The data items read out are converted by a digital-to-analog converter 64 into a video signal, which is then transmitted to and displayed by the display device 1. As part of this operation, a scan address calculator 62 for determining the retrieval (frame memory) address checks the address of the frame memory 5 and the address designated by the processor 3 and controls the scan address so as not to miss the frame memory window area, in accordance with the frame memory window information given by the processor 3 and stored in register 61. Thus, only the data items within the window are displayed on the screen of the display device 1. Therefore, a scrolling of the displayed data can be realized by gradually shifting the position of the frame memory window.

In the system of FIG. 3, the operator specifies the scrolling direction and the scrolling speed by the use of the input unit 8, and the processor 3 moves the position of the frame memory window according to this information, as stated above. In this way, the content of the pattern presented on the display 1 is shifted and scrolled in a direction and at a speed desired by the operator.

What has been described so far is a standard technique for the scrolling of a screen display. Obviously, such scrolling may be implemented using other systems than the specific one described with reference to FIGS. 3 and 4, and so it should be understood that the present invention is not limited to the scrolling technique specifically described.

Figure 5:
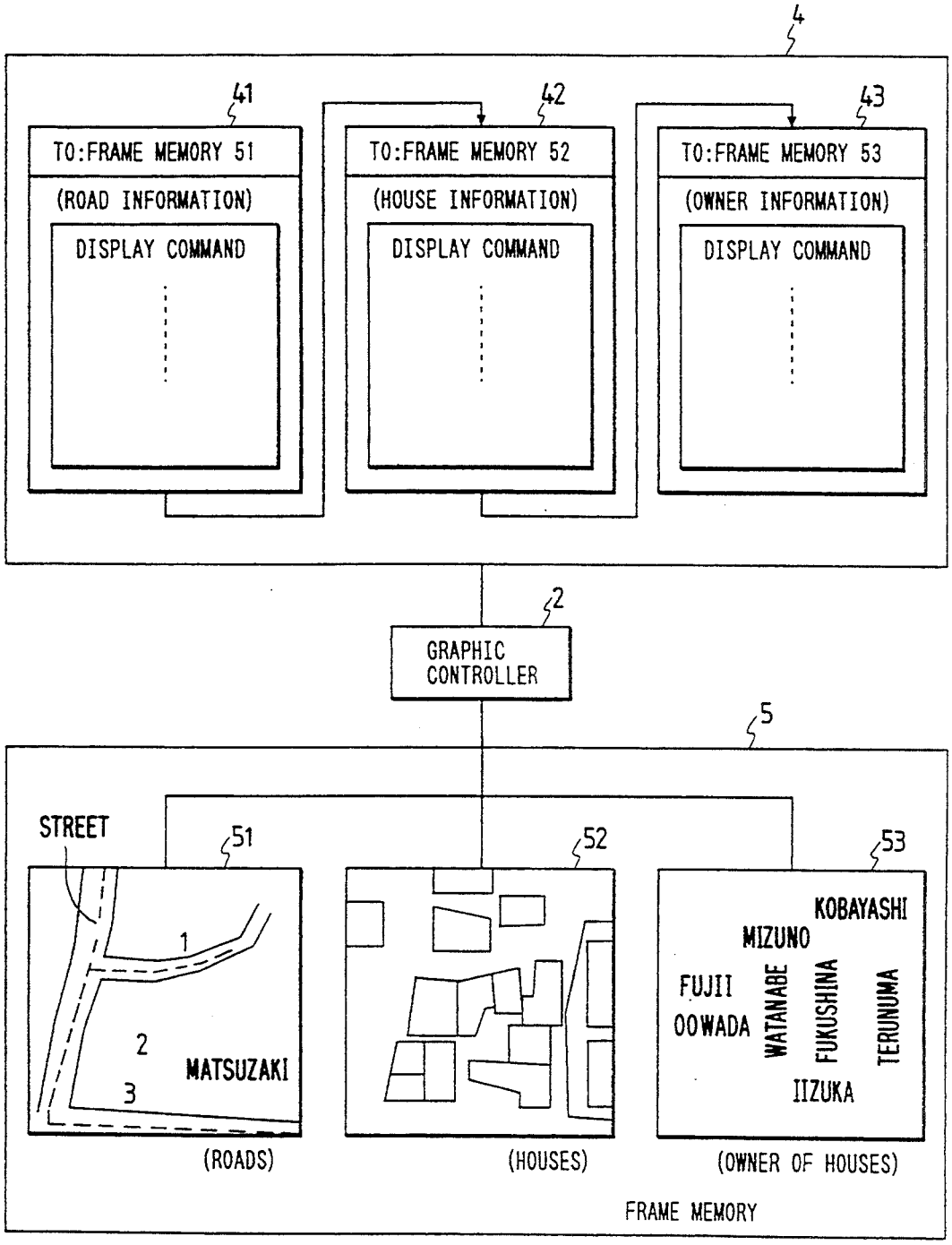
FIGS. 5 and 6 are block diagrams showing the essential portions of a first embodiment of a displayed picture scrolling apparatus according to the present invention.
Figure 6:
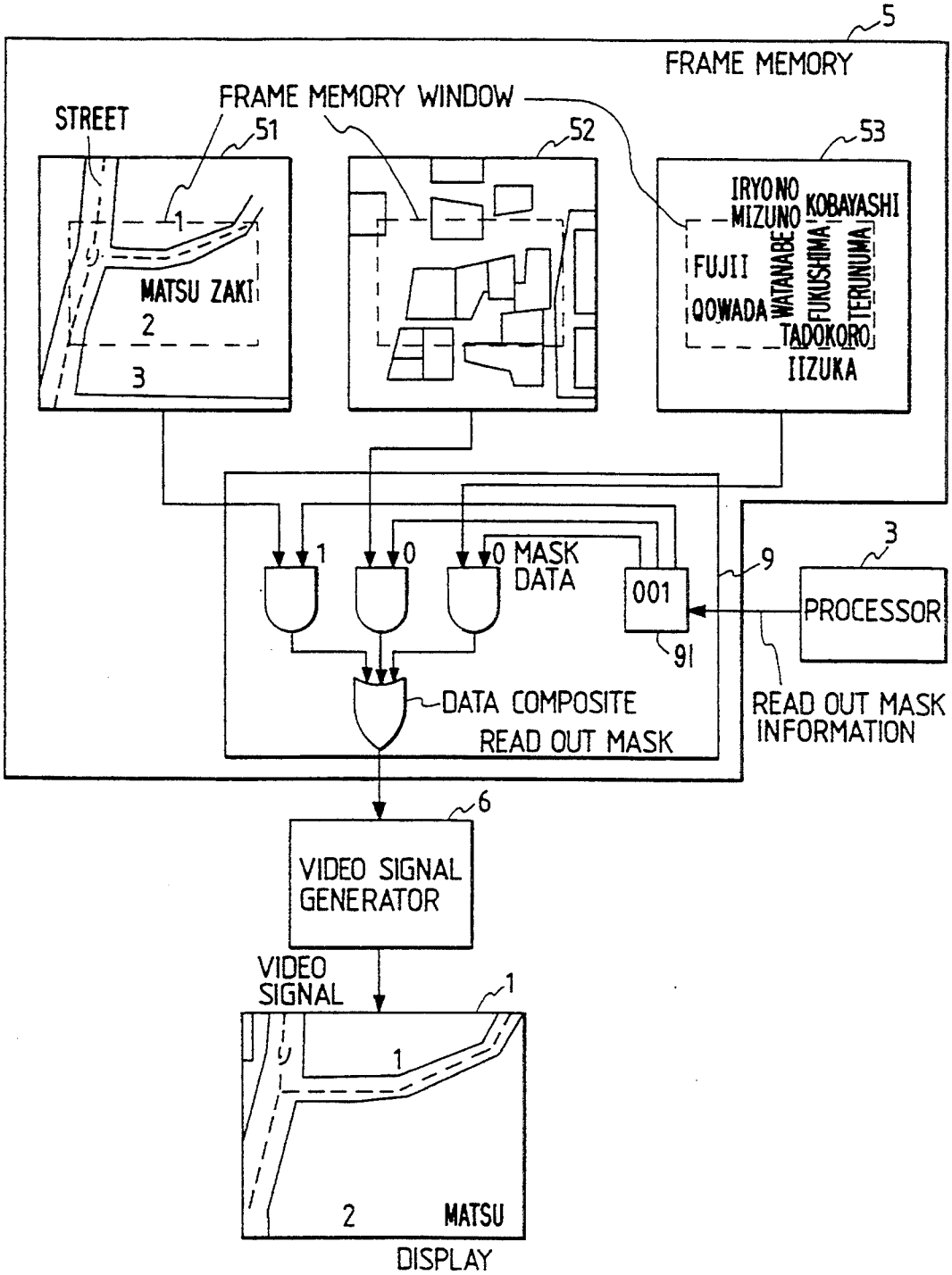

FIGS. 5 and 6 show the essential portions of a first embodiment of the present invention. In these figures, the same constituent elements as shown in FIGS. 3 and 4 have identical reference numerals assigned thereto.

Three individual frame memories 51–53, each of which is equivalent in size to the frame memory 5 shown in FIG. 3, are provided to form the system frame memory 5. Data can be written from the graphic controller 2 into selected ones of the frame memories 51–53, respectively.

Pattern information items which are to be displayed, and the frame memories (51–53) in which they are to be stored, are designated from the processor 3 to the graphic controller 2 by the use of specified display command data read out of graphic memory 4. In this example, the map pattern information items are classified by output destination appointing commands into three groups including a road information group 41, a house information group 42 and an owner information group 43, which are respectively stored in the frame memories 51–53. However, this manner of classification is not restrictive, but is determined by the pattern information items which are present in the displayed data and not sought in the scrolling operation. In addition, any number of frame memories may be provided to attain the features of the present invention, so long as the number is at least two.

The pattern information items thus stored in the respective frame memories 51–53 are loaded in the video signal generator 6 through a frame memory readout masking device 9, as seen in FIG. 6. The frame memory readout masking device 9 masks the readout of the frame memories 51–53 in accordance with frame memory readout masking information which is provided from the processor 3 and held in register 91. Thus, only the content of the frame memory not masked is displayed on the screen of the display device 1. The example of FIG. 6 illustrates a state in which the contents of the frame memories 52 and 53 are masked.

Upon receiving the instruction for the scrolling operation from the input unit 8, the processor 3 supplies the frame memory readout masking device 9 with masking information as mentioned above, whereby the selective display of data can be realized. By controlling the content of the masking register 91, the processor 3 can produce selective masking of display data during scrolling.

Figure 1:
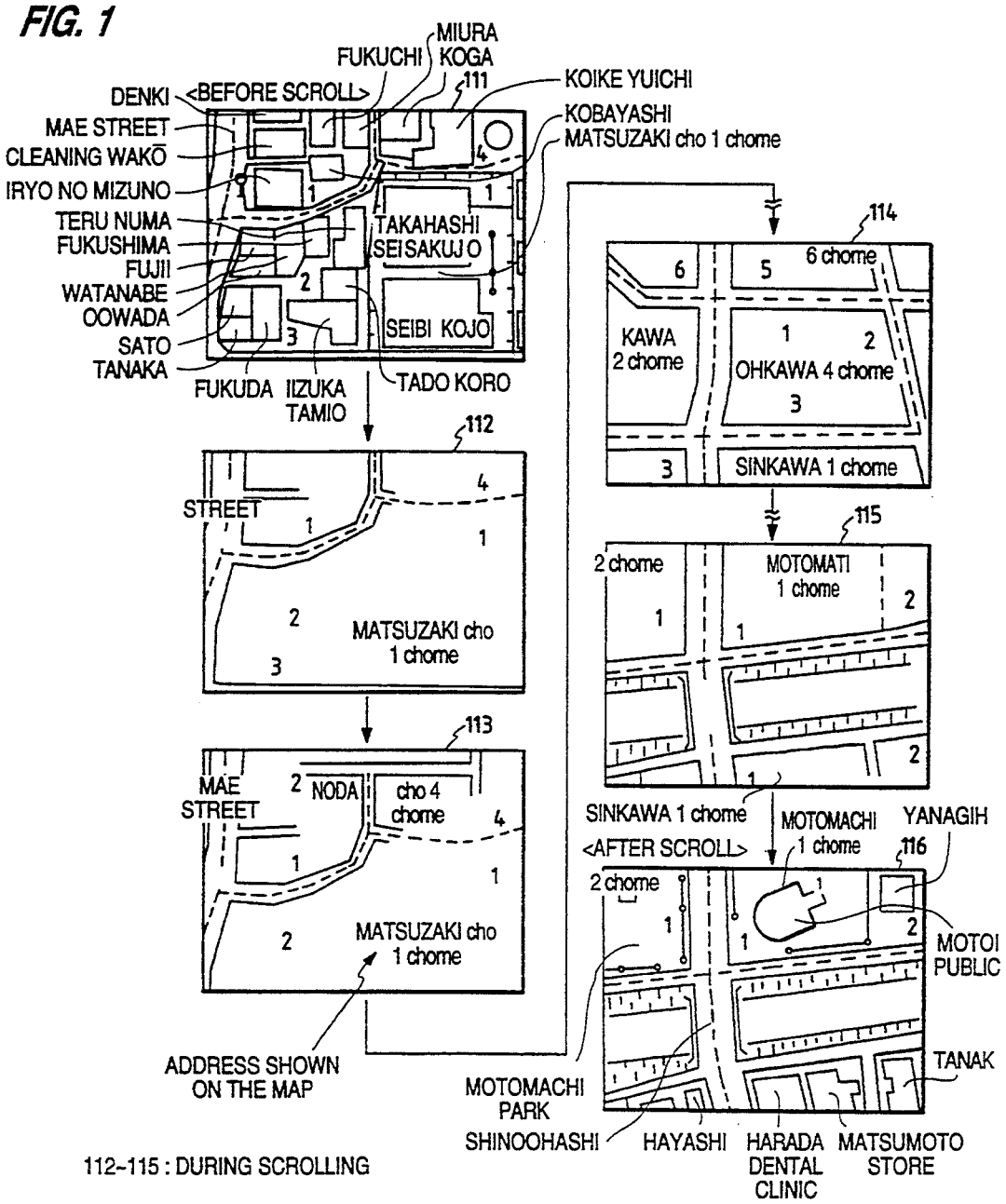
FIGS. 1 and 2 are diagrams of displayed examples of scrolled pictures each showing the operation of a displayed picture scrolling method according to the present invention.

FIG. 1 shows an example of scrolled pictures based on this embodiment. Among the road information, house information and owner information shown in FIG. 5, only the road information is displayed during the scrolling operation using the example adopted in FIG. 6.

More specifically, the road information, house information and owner information are all indicated in a displayed picture 111 before the scrolling is indicated. At this time, the masking register 91 stores "111". During the scrolling, however, the pictures are in the states in which, among the pattern information items to-be-displayed, the house information and the owner information are omitted from the pictures, and only the road information is indicated (strictly speaking, the names of streets such as "1-chome, Matsuzaki-cho", etc, are also indicated), as shown at 112→113→114→115. During this time, the masking information in register 91 is "001", as seen in FIG. 6. All the pattern information items are indicated again in a displayed picture 116 after the scrolling is completed and the objective has been retrieved, simply by changing the information in register 91 to "111" once again. This scrolling example is convenient in a case where the operator himself/herself knows the road information well and retrieves the objective along the road.

In the first embodiment, the amount of pattern data displayed during the scrolling operation is small as stated before, so that the flickering of the displayed pattern is reduced to enhance the operating efficiency for the operator.

Now, a second embodiment of the present invention will be described with reference to FIGS. 7(*a*) and 7(*b*). The command data items stored in the pattern command data (graphic) memory 4 contain attribute data for designating whether the pattern is to be presented with an ordinary indication, i.e. in ordinary colors, or in an emphatic indication, such as by highlighting or blinking. This data is loaded in the graphic controller 2 under control of processor 3, so that it is possible to present any desired pattern information either by emphatic indication or ordinary indication.

Figure 7A:
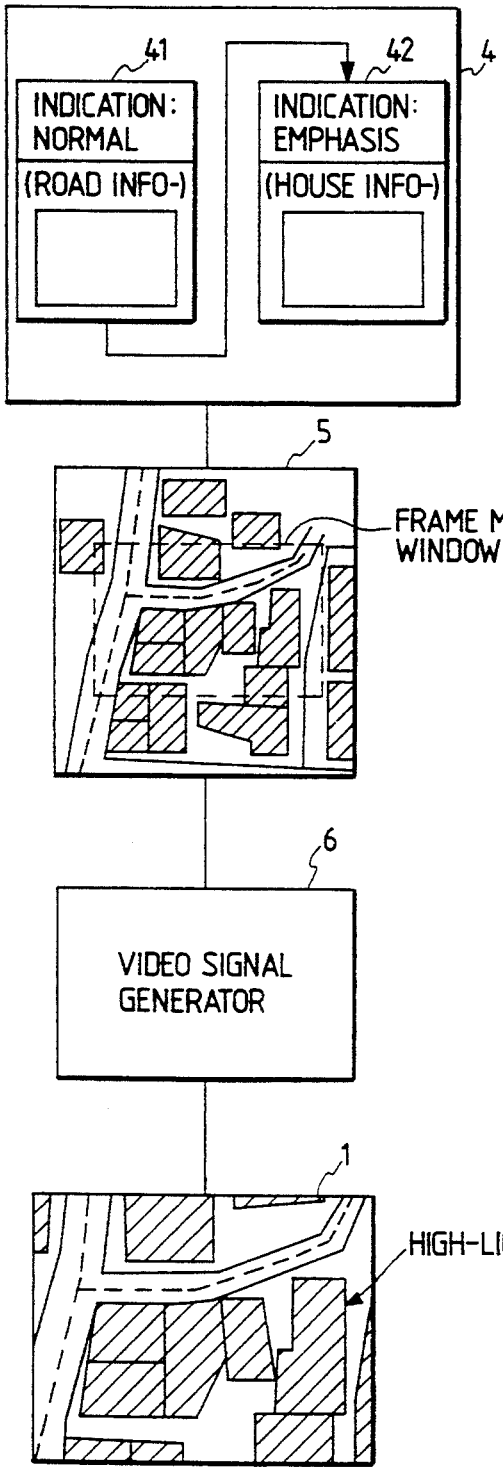
FIGS. 7(*a*) and 7(*b*) are block diagrams showing a second embodiment of the present invention.
Figure 7B:
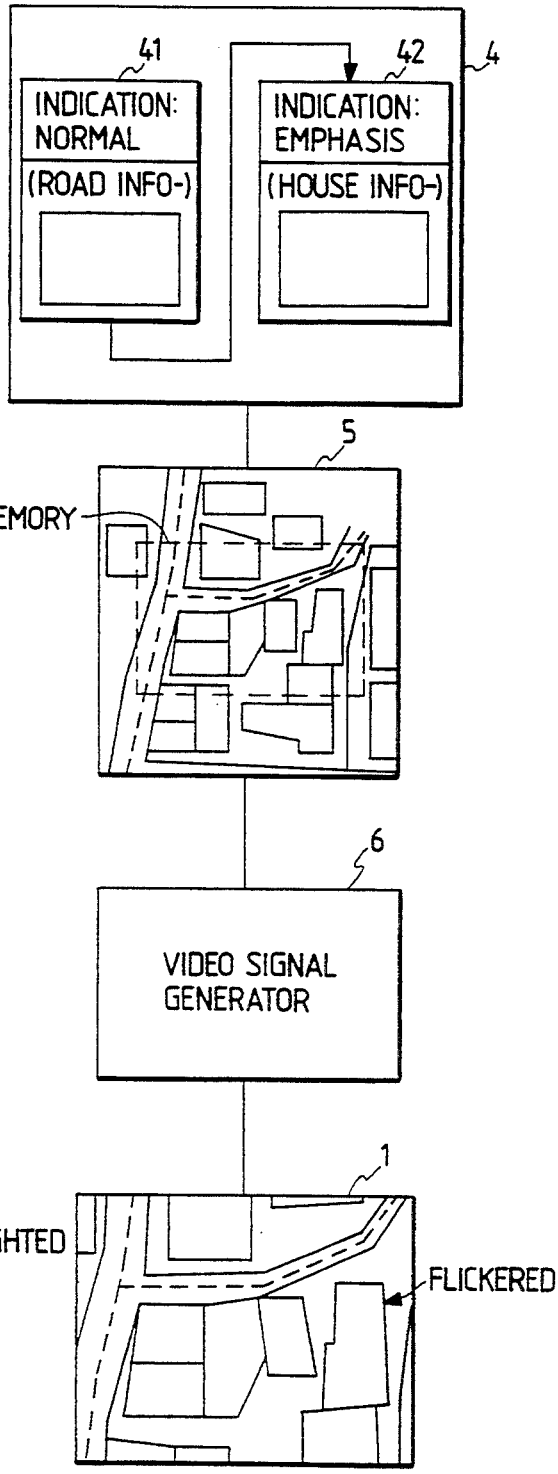

FIG. 7(*a*) shows an example in which only the house information is emphatically indicated, while FIG. 7(*b*) shows an example in which all the pattern information items are ordinarily indicated. In this manner, any desired pattern information can be presented using emphatic indication or ordinary indication. Therefore, scrolling in which the object to be retrieved is easily tracked by the eye can be realized in such a way that the processor 3 brings the partial pattern information into the emphatic indication during the scrolling operation.

Figure 2:
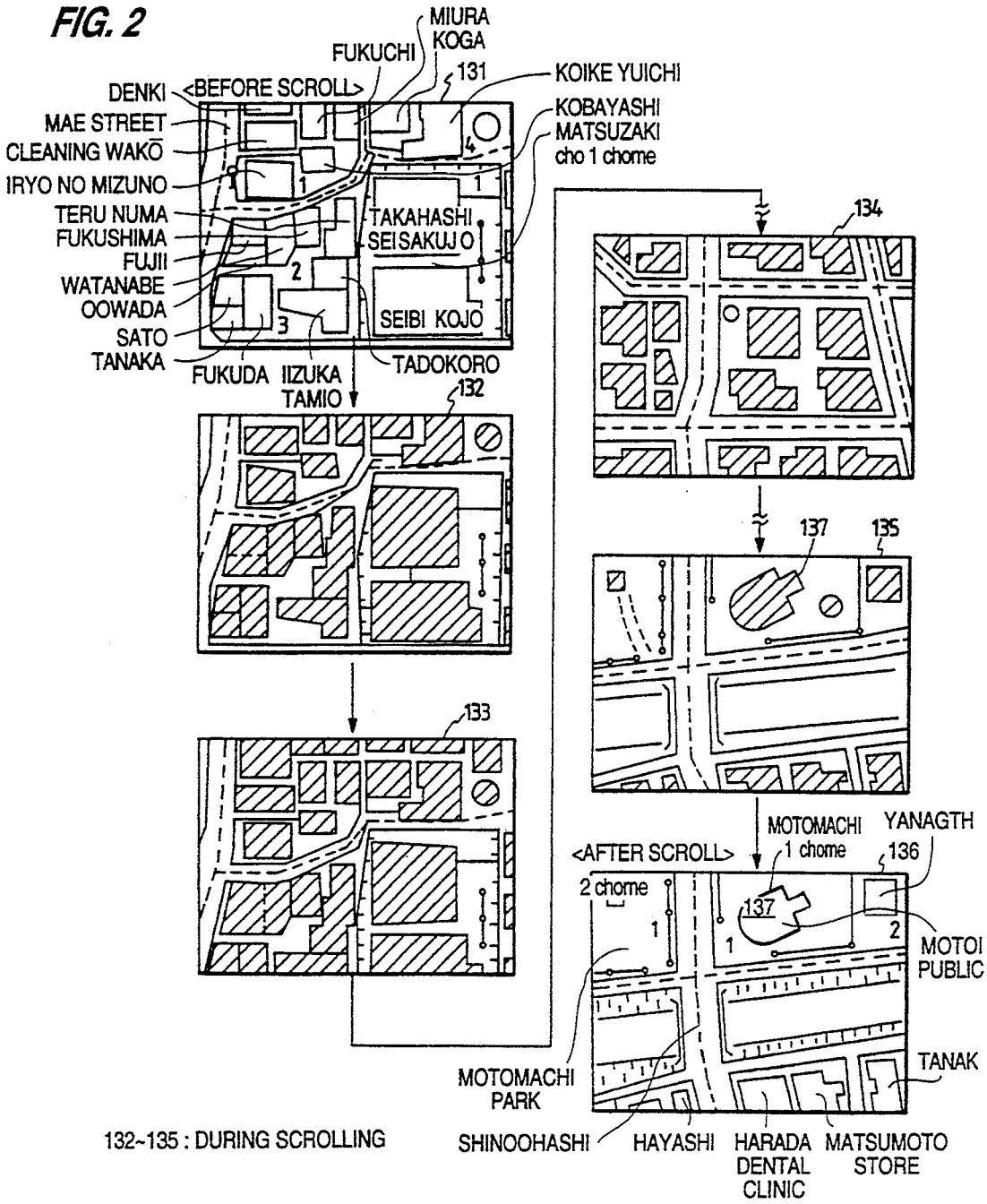

FIG. 2 shows a scrolling example based on this second embodiment. For a displayed picture 131 produced before the scrolling is initiated, all pattern information items are displayed using ordinary indication. However, pattern information items are indicated with house information emphasized, as shown at 132→133→134→135 during the scrolling operation. Shown at numeral 136 is a displayed picture produced after the scrolling is completed.

In a case where an object to be retrieved, such as "Motomachi Public Hall" denoted at numeral 137 in FIG. 2, has a special shape, this example facilitates the scrolling in which the object to be retrieved is tracked with the eye. Although the house information is emphatically indicated in the figure, only road information may well be emphatically indicated. Thus, this embodiment facilitates the tracking or retrieval during the scrolling and is especially effective for display of pattern information in which no information is omitted during the scrolling operation.

Figure 8:
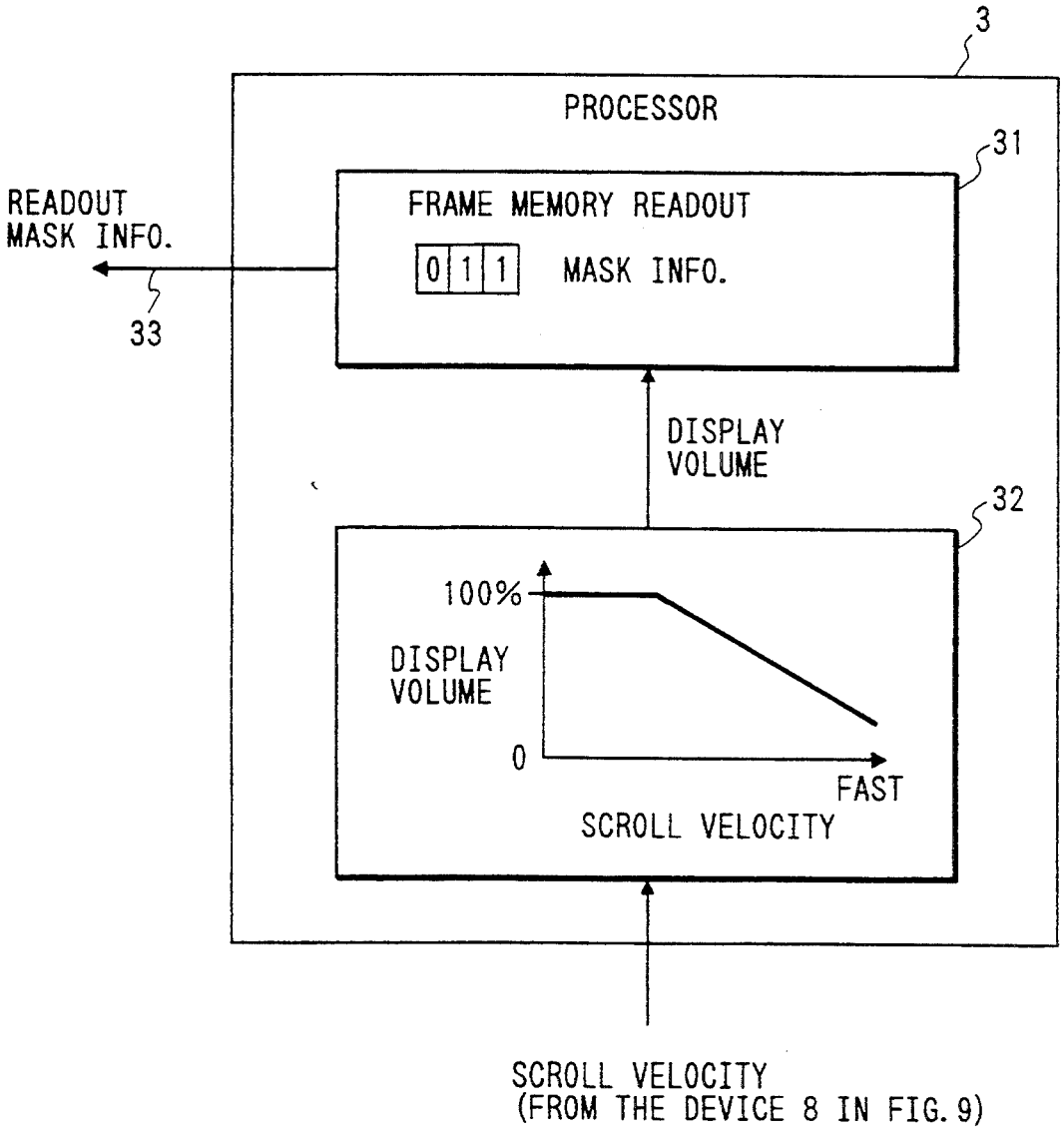
FIG. 8 is an operating flow diagram showing a third embodiment of the present invention.

FIG. 8 concerns a third embodiment of present invention, and illustrates the operation of a processor which changes the amount of pattern data of an object to-be-scrolled, depending upon the scrolling speed.

Referring to the figure, a processor 3 equivalent to the processor in FIG. 3 receives information indicating the scrolling direction and the scrolling speed from the input unit 8, and it calculates the amount of pattern data to-be-scrolled on the basis of the scrolling speed by means of an arithmetic unit 32. In general, the calculation is carried out such that, as the scrolling speed increases, the amount of pattern data to-be-scrolled decreases. In conformity with that amount of pattern data to-be-scrolled which has been determined here, a unit 31 determines the frame memory readout masking required, as described before, and supplies the frame memory masking information 33 to the frame memory readout masking device 9 shown in FIG. 6. Thus, for one low range of scrolling speed, a mask pattern 33 equal to 111 may be employed; while, for a middle range of scrolling speed, a mask pattern 33 equal to 011 is adopted. For a high range of scrolling speed, a mask pattern 33 equal to 001 is used.

According to this embodiment, the amount of information to-be-indicated can be changed in accordance with the scrolling speed. Therefore, an objective can be reliably retrieved, and besides, the fatigue of the eyes can be relieved, by executing a scrolling operation in which, when the objective is at a distance from the displayed data in extensive pattern data, a small amount of information is indicated at high speed, and in which, as the objective comes near, all information items are indicated at low speed.

Figure 9:
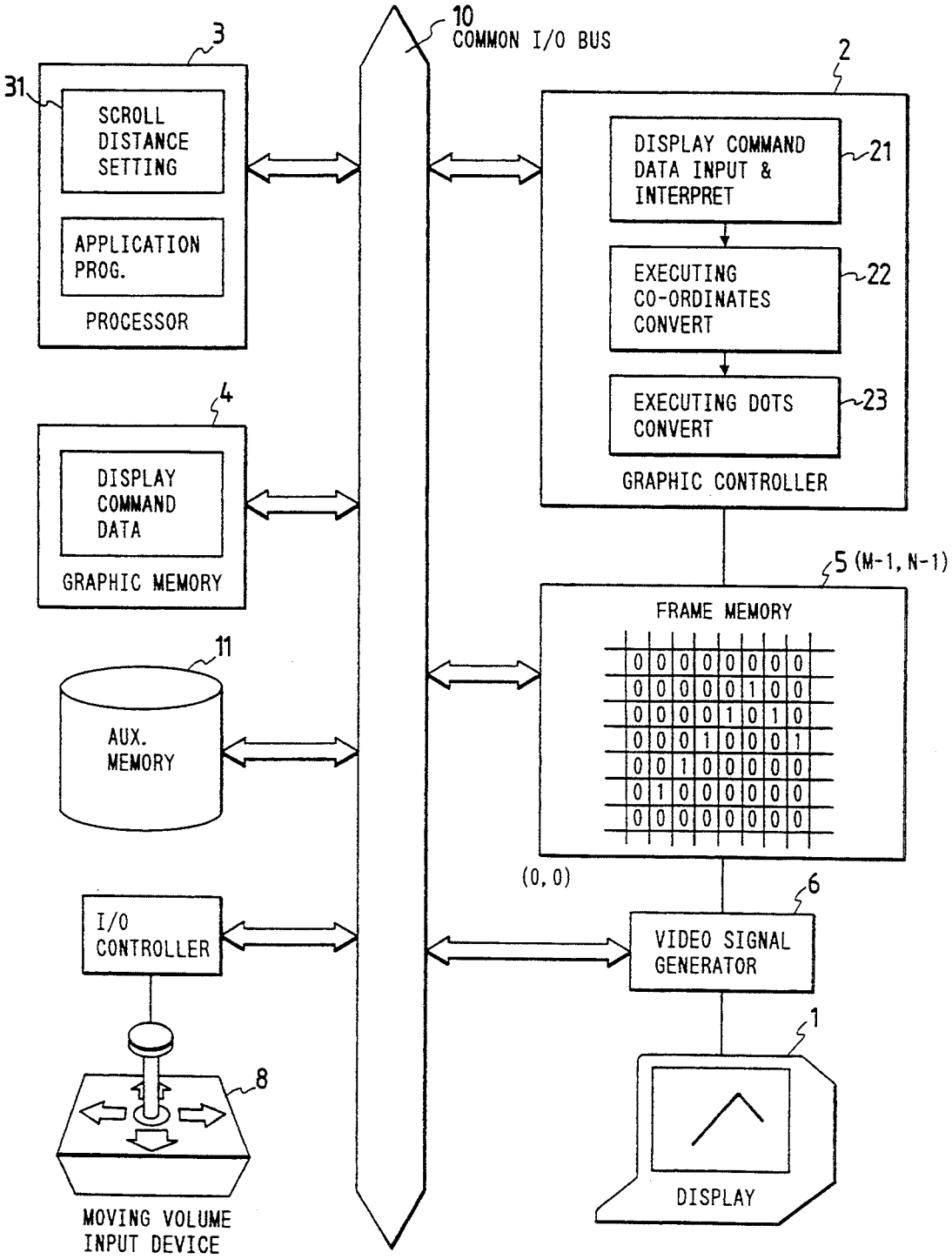
FIG. 9 and FIGS. 10(*a*) thru FIG. 11 are a schematic block diagram and operating flow diagrams showing a fourth embodiment of the present invention, respectively.
Figure 10A:
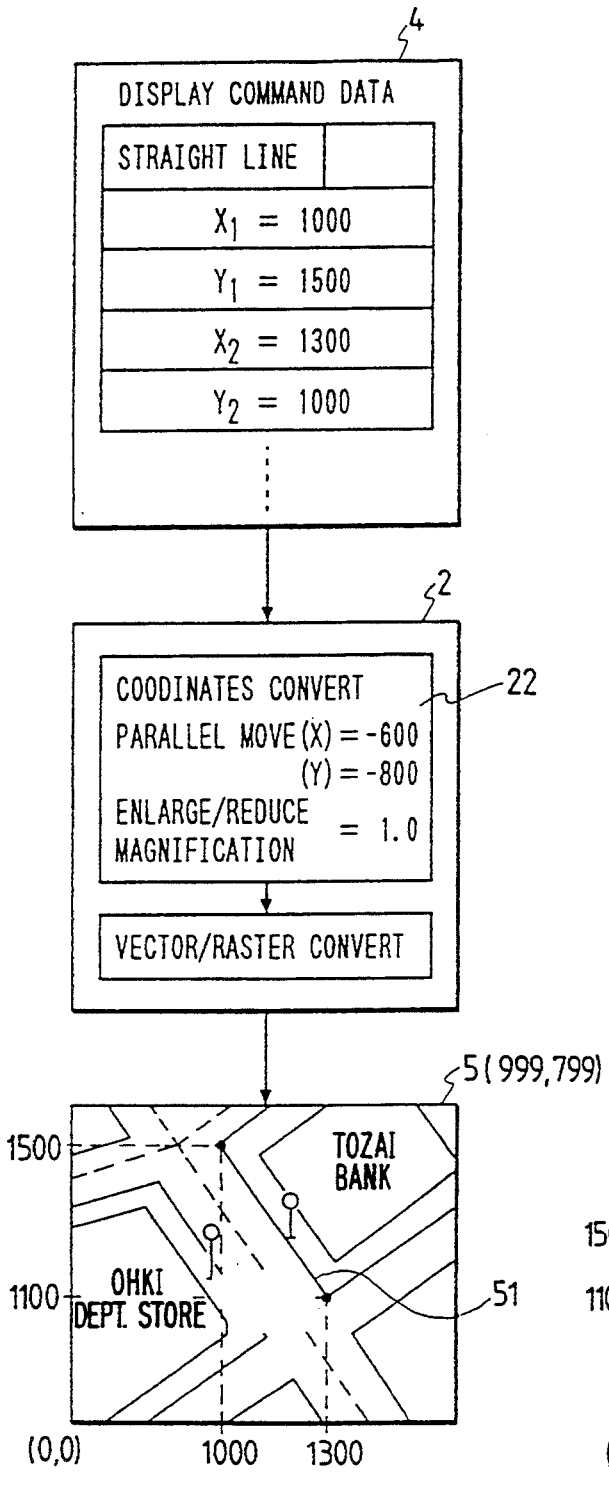
Figure 10B:
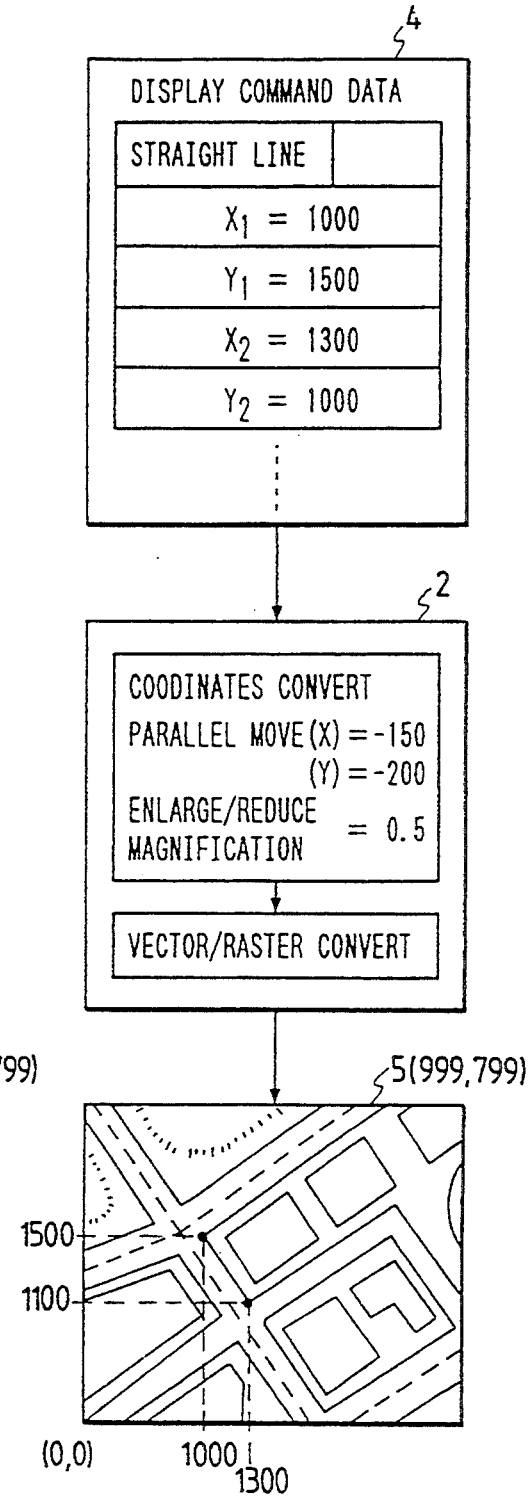
Figure 11:
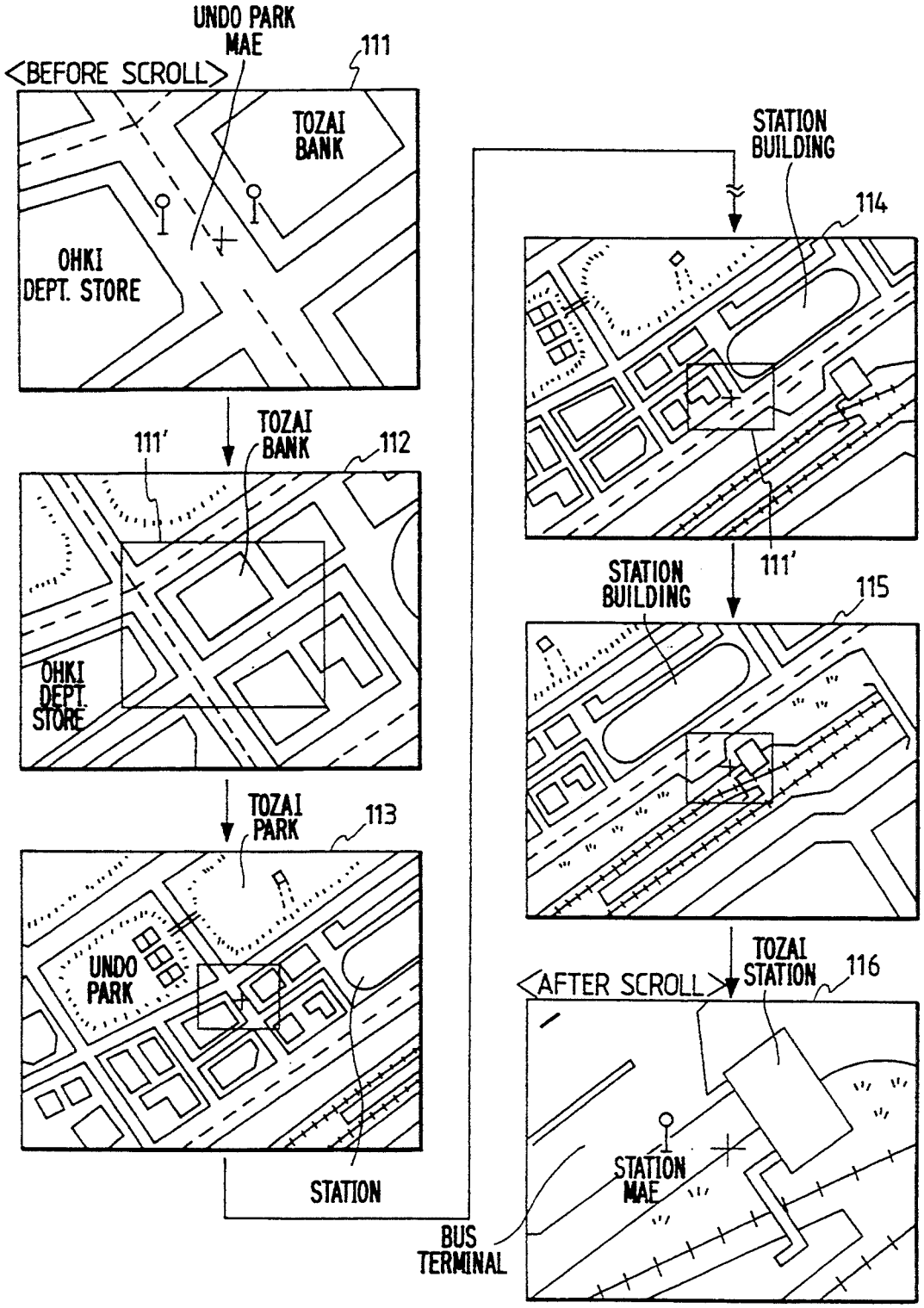
Figure 12:
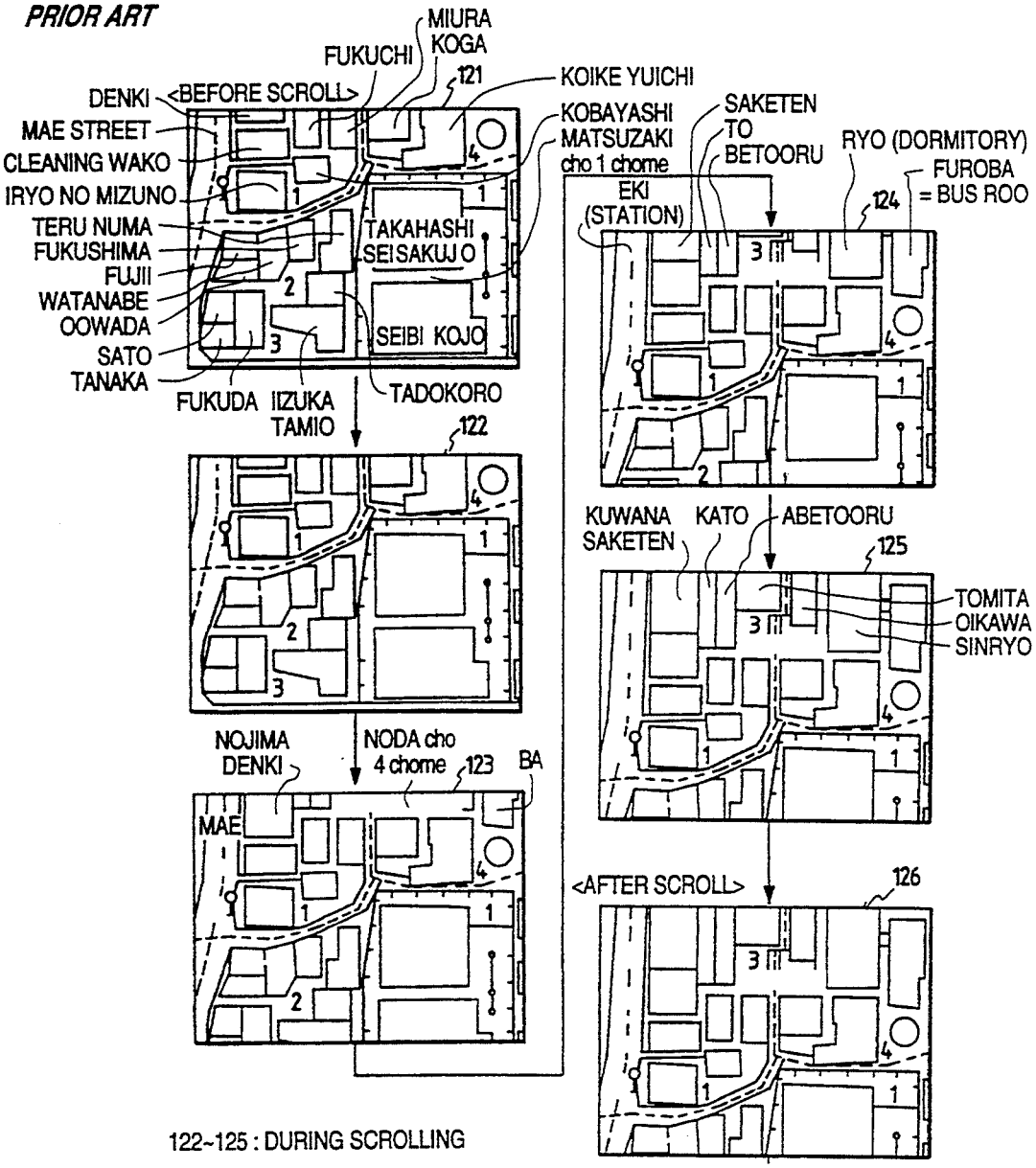
FIG. 12 PRIOR ART
FIG. 12 is an explanatory diagram showing an example of scrolled pictures based on a prior-art system.

FIG. 9, FIGS. 10(*a*), 10(*b*), and FIG. 11 show a fourth embodiment of the present invention in which data to be displayed is enlarged or reduced in size during a scrolling operation. In FIG. 9, the same constituent elements as in FIG. 3 have identical reference numerals assigned thereto.

In this example, pattern command data is accepted into the pattern drawing computation unit 22 of the display controller 2 in compliance with a request for display, so as to be transformed into the vector (dot pattern) data of the coordinate system of the frame memory 5. Thereafter, the transformed data is written into the frame memory 5 via the dot development unit 23 of the display controller 2.

The pattern drawing computation unit 22 transforms the coordinate values of the display command data stored in the command data memory 4 into the values of the coordinate system of the frame memory 5 corresponding to the coordinates of the screen of the display device 1, on the basis of a movement value as stated before and a preset factor of enlargement or reduction.

A scrolling distance setting unit 31 calculates movement values in the coordinate system of the pattern, on the basis of the received movement value, and it designates coordinate transformation parameters for the pattern drawing computation unit 22. As will be described later, the coordinate transformation parameters include the value of translation and the enlargement/reduction factor.

The display command data loading and interpreting unit 21 of the display controller 2 executes calculations, such as straight line approximations and curve computations, which are required in displaying the display command data on the screen. The dot development unit 23 executes calculations for developing in the frame memory 5 that vector data of the coordinate system of the frame memory 5 which has been calculated by the pattern drawing computation unit 22.

Next, the operation of the apparatus in FIG. 9 will be described with reference to FIGS. 10(*a*) and 10(*b*). In the command data (graphic) memory 4, the type of each pattern (for example, a straight line) and the coordinate values ($X_1$, $Y_1$), ($X_2$, $Y_2$) of both the end points of the straight line are stored as the display command data. It is now assumed that the pertinent display command data serves to indicate one section 51 of a road by the side of Tozai Bank as stored in the frame memory 5. It is also assumed that the size of the frame memory 5 is 1000 pixels in the direction of an X-axis and 800 pixels direction of a Y-axis.

The coordinate transformation is performed by a method which designates the translation values and enlargement/reduction factors in the X-axial and Y-axial directions. Any desired part of the large number of pattern command data items can be indicated by altering the translation values. In addition, a picture can be indicated in any desired size by altering the enlargement/reduction factors. These operations will be described using exemplary coordinate values.

In FIG. 10(*a*), the coordinate values of the two end points ($X_1$, $Y_1$) and ($X_2$, $Y_2$) are (1000, 1500) and (1300, 1100), respectively. The two points are first subjected to coordinate transformations of the translations. Assuming by way of example that translation values of −600 and −800 are respectively set in the X direction and Y direction, the results of the coordinate transformations become (400, 700) and (700, 300). Further, assuming an enlargement/reduction factor=1.0 for the coordinate transformations, the results remain unchanged. Vector/raster conversion is performed using the coordinate values, and data is written into the corresponding pixels of the frame memory 5.

FIG. 10(*b*) shows an example in which, although the same display command data is to be indicated, the translation values are set at −300 in the X direction and −500 in the Y direction, and the enlargement/reduction factor is set at 0.5. The results of the coordinate transformations become (350, 500) and (500, 300). The position and size of data actually displayed is shown at numeral 5 in FIG. 10(*b*).

Next, there will be described a method in which the parameters of the coordinate transformation are altered in accordance with the scrolling direction and scrolling speed applied as inputs by the operator.

The translation values determined from the scrolling direction and speed specified by the operator. First, the central coordinate values of a pattern being currently indicated are obtained. In the case of FIG. 10(*a*), the frame memory size is 1000 pixels in the X direction and 800 pixels in the Y direction, and the translation parameter values of the coordinate transformation are −600 in the X direction, and −800 in the Y direction. Therefore, the origin (0, 0) of the frame memory 5 corresponds to (600, 800) in terms of the coordinates of the display command data. Further, the central point (500, 400) of the frame memory 5 corresponds to (1100, 1200) similarly in terms of the coordinates of the display command data.

Subsequently, the enlargement/reduction factor parameter is evaluated. It is obtained from the scrolling speed specified by the operator. By way of example, the scrolling speed is specified as that distance on the coordinate system of the display command data which is to be moved during one scrolling step. In addition, that distance on the coordinate system of the screen (the frame memory 5) which is to be moved during one scrolling step is set within an extent allowing the human eye to follow the movement easily. More specifically, when the movement distance on the screen is too long, the impression of a sudden change in the picture is given, and the operator fails to chase properly track the pattern. Usually, a value of 2–3 cm is appropriate as the distance which the picture is moved by one scrolling step on a screen having a diagonal length of 20 inches.

As a concrete example, it is assumed that the picture is to be moved 2 cm by one scrolling step. Then, if one pixel of the frame memory 5 is about 0.2 mm long, the picture may be moved 100 pixels. Assuming that the distance on the coordinate system of the display command data as specified by the operator is also 100, the enlargement/reduction factor parameter becomes 100+100=1.

The translation value is determined as follows:

$$-(X\text{-directional movement value parameter}) = (\text{Current central } X\text{-coordinate}) - (X\text{-directional movement value specified by the operator}) + (\text{enlargement/reduction factor}) - (X\text{-directional size of the frame memory}) + 2 \quad (1)$$

The X-directional movement value parameter will be obtained below by substituting the aforementioned concrete coordinate values into Eq. (1).

−(X-directional movement value parameter)={1100−(−100)}+1−500=1200−500=700

Next, let's consider a case where, in order to retrieve an objective still faster, the operator has specified scrolling speed values of −200 in the X direction and 0 in the Y direction. First, the enlargement/reduction factor parameter is evaluated. As stated before, it is obtained by the following:

$$(\text{Enlargement/reduction factor parameter}) = (\text{Movement distance on the screen}) + (\text{Movement distance on the pattern command data}) \quad (2)$$

Concretely, it becomes:

(Enlargement/reduction factor parameter)=100+200=0.5 Subsequently, the translation value is given by Eq. (1). Concretely, it is obtained as follows:

−(X-directional movement value parameter)={1100−(−200)},
×0.5−500=1300×0.5−500=150

In this way, the parameters of the coordinate transformation are successively altered in accordance with the scrolling speeds specified by the operator, whereby the scrolling at the degree at which a man can follow or track the movement of the indicated object on the screen with the eyes becomes possible when a high-speed scrolling operation has been requested. Incidentally, the distance to be moved on the screen by one scrolling step may be held at a fixed value at all times or may well be set by the operator on each occasion.

An example of scrolled pictures based on this embodiment is shown in FIG. 11. In the figure, numerals 111 and 116 denote pictures before and after the scrolling, respectively. Although these pictures present the different areas of an urban map, they have the same reduction scale. On the other hand, numerals 112–115 denote the pictures in the course of the scrolling. The pictures 113–115 are scrolled at high speed, and thy have great reduction rates. The picture 112 is scrolled at a speed lower than those of the pictures 113–115, and the reduction rate thereof is greater than that of the picture 111, but is smaller than that of the picture 113.

It is convenient for clearly designating the screen area position that a screen area indication 111' outlining the screen area before and after the scrolling is also presented in each of the pictures 112–115.

The operation of this embodiment is similar to viewing scenes from the window of a running car. More specifically, in the distant view, objects are seen on reduced scales. Therefore, even when a large number of objects are seen (in a wide field of vision), the amount of information changes little, and hence, the eyes are not fatigued. In contrast, in the close-range view, objects are in actual sizes. Therefore, even when the number of objects to be seen is small, the amount of information changes greatly, and hence, the eyes fatigue quickly. Thus, in this example, the pattern size is reduced when the speed is high, whereby the tracking of the objective in the scrolling operation can be facilitated without disturbing the amount of information being displayed.

In the above, a plurality of embodiments of the present invention have been described by exemplifying urban maps. However, various other objects may be considered for the application of the present invention. By way of example, the present invention is also applicable to the indications of a topographical map expressed by contour lines, the design drawing of a product, the flow diagram of a plant, various kinds of circuit diagrams, various kinds of charts, and character strings, such as sentences.

Moreover, pictures can be made easier to see by combining the foregoing aspects of performance of the present invention, for example, by conjointly employing the expedient in which a specified one of pattern information items indicated on the display screen is temporarily omitted from the screen display or is emphasized conversely during the scrolling operation and the expedient in which the size of a pattern is enlarged or reduced in accordance with the scrolling speed.

As described above in detail, the present invention realizes scrolling in which, even when the speed thereof is high, a pattern is easy to retrieve, and the fatigue to the eyes is greatly lessened.

While the present invention has been described in terms of its preferred embodiments, it should be understood that numerous modifications may be made thereto without departing from the spirit and scope of the invention as defined in the appended claims. It is intended that all such modifications fall within the scope of the appended claims.

What is claimed is:

1. A method of controlling the display of graphic data in a graphic data display system having a memory for storing graphic data, a display device for displaying graphic data and means for controlling the read-out of graphic data from said memory to said display device to effect scrolling of displayed graphic data under control of an operator, the method comprising the steps of:

displaying graphic data using said display device; controlling the read-out of graphic data from said memory to said display device to effect scrolling of displayed graphic data for a period of time in response to a scrolling command from an operator; and changing according to the speed of said scrolling, the amount of the graphic data being displayed by said display device during said period of time to facilitate the viewing of the displayed graphic data during scrolling;

wherein said step of changing the amount of the graphic data being displayed comprises the step of: selectively omitting a portion of the graphic data to be displayed from being displayed during the scrolling.

2. A method according to claim 1, wherein the graphic data to be displayed is divided into plural categories, and at least one category of graphic data is omitted from data being displayed by said display device during scrolling.

3. A method according to claim 2, wherein the number of categories of graphic data omitted from being displayed by said display device is varied with changes in the speed of said scrolling.

4. A method of controlling the display of graphic data in a graphic data display system having a memory for storing graphic data, a display device for displaying graphic data and means for controlling the read-out of graphic data from said memory to said display device to effect scrolling of displayed graphic data under control of an operator, the method comprising the steps of:

displaying graphic data using said display device; controlling the read-out of graphic data from said memory to said display device to effect scrolling of displayed graphic data for a period of time in response to a scrolling command from an operator; and changing according to the speed of said scrolling, the amount of the graphic data being displayed by said display device during said period of time to facilitate the viewing of the displayed graphic data during scrolling;

wherein said step of changing the amount of the graphic data being displayed comprises the step of: omitting different amounts of the graphic data to be displayed from being displayed according to the speed of said scrolling.

5. A method according to claim 4, wherein a greater amount of graphic data is omitted as the speed of said scrolling increases.

6. A method of controlling the display of graphic data in a graphic data display system having a memory for storing graphic data, a display device for displaying graphic data and means for controlling the read-out of graphic data from said memory to said display device to effect scrolling of displayed graphic data under control of an operator, the method comprising the steps of:

displaying graphic data using said display device; controlling the read-out of graphic data from said memory to said display device to effect scrolling of displayed graphic data for a period of time in response to a scrolling command from an operator; and changing according to the speed of said scrolling, the amount of the graphic data being displayed by said display device during said period of time to facilitate the viewing of the displayed graphic data during scrolling;

wherein the step of changing the amount of the graphic data being displayed comprises the step of: altering the magnification of the graphic data being displayed during said scrolling;

wherein said step of changing the amount of the graphic data being displayed further comprises the step of:

selectively omitting a portion of graphic data to be displayed from being displayed during the scrolling.

7. A method according to claim 6, wherein the magnification of the data being displayed is varied with variation in the speed of said scrolling.

8. A method according to claim 7, wherein the graphic data to be displayed is divided into plural categories, and at least one category of graphic data is omitted from data being displayed by said display device during scrolling.

9. A method according to claim 7, wherein said step of changing the graphic data being displayed comprises the step of:

omitting different amounts of the graphic data to be displayed from being displayed according to the speed of said scrolling.

10. An apparatus for controlling the display of graphic data, comprising:

a memory for storing graphic data to be displayed; a display device for displaying graphic data; and processor for reading graphic data from said memory and supplying said graphic data to said display device to display graphic data, and including scrolling means, responsive to a command from an operator, for controlling the graphic data being read out of said memory to effect scrolling of the graphic data on said display device and control means for changing, according to the speed of said scrolling the amount of the graphic data read out of said memory during scrolling to facilitate the viewing of the displayed graphic data on said display device;

wherein said control means comprises means for changing the quantity of data displayed by said display device by selectively preventing a portion of the graphic data from being supplied from said memory to said display device by said scrolling means.

11. An apparatus according to claim 10, wherein said graphic data is stored in said memory as plural categories of graphic data, and said control means comprises means for inhibiting said scrolling means from reading out at least one category of graphic data during scrolling, thereby reducing the amount of graphic data displayed by said display device during scrolling.

12. An apparatus according to claim 11, wherein said control means inhibits a different number of categories of graphic data for different scrolling speeds, so that more graphic data is omitted from being displayed by said display device as the scrolling speed increases.

13. An apparatus for controlling the display of graphic data, comprising:

a memory for storing graphic data to be displayed; a display device for displaying graphic data; and a processor for reading graphic data from said memory and supplying said graphic data to said display device to display graphic data, and including scrolling means, responsive to a command from an operator, for controlling the graphic data being read out of said memory to effect scrolling of the graphic data on said display device and control means for changing, according to the speed of said scrolling, the amount of the graphic data read out of said memory during scrolling to facilitate the viewing of the displayed graphic data on said display device;

wherein said control means comprises means for controlling said scrolling means to read different amounts of graphic data from said memory according to the speed of said scrolling.

14. An apparatus according to claim 13, wherein said control means controls said scrolling means to read smaller amounts of graphic data from said memory as the scrolling speed increases.

15. An apparatus for controlling the display of graphic data, comprising:

a memory for storing graphic data to be displayed; a display device for displaying graphic data; and a processor for reading graphic data from said memory and supplying said graphic data to said display device to display graphic data, and including scrolling means, responsive to a command from an operator, for controlling the graphic data being read out of said memory to effect scrolling of the graphic data on said display device and control means for changing, according to the speed of said scrolling, the amount of the graphic data read out of said memory during scrolling to facilitate the viewing of the displayed graphic data on said display device;

wherein said control means comprises means for altering the graphic data read out of said memory by changing the magnification thereof as displayed by said display device during scrolling;

wherein said control means further comprises means for changing the quantity of data displayed by said display device by selectively preventing a portion of the graphic data from being supplied from said memory to said display device by said scrolling means.

16. An apparatus according to claim 15, wherein said control means operates to vary the magnification of the graphic data in proportion to the scrolling speed.

17. An apparatus according to claim 16, wherein said graphic data is stored in said memory as plural categories of graphic data, and said control means comprises means for inhibiting said scrolling means from reading out at least one category of graphic data during scrolling, thereby reducing the amount of graphic data displayed by said display device during scrolling.

18. An apparatus according to claim 16, wherein said control means comprises means for controlling said scrolling means to read different amounts of graphic data from said memory according to the speed of scrolling.

* * * * *